US006544051B1

(12) United States Patent
Su

(10) Patent No.: US 6,544,051 B1
(45) Date of Patent: Apr. 8, 2003

(54) ELECTRICAL ADAPTER

(75) Inventor: Chun-Chou Su, Kaohsiung (TW)

(73) Assignee: Salom Electric Co., Ltd., Samphan Nakornpathom (TH)

( * ) Notice: Subject to any disclaimer, the term of this patent is extended or adjusted under 35 U.S.C. 154(b) by 0 days.

(21) Appl. No.: 09/973,497

(22) Filed: Oct. 9, 2001

(51) Int. Cl.[7] ..... H01R 13/44
(52) U.S. Cl. ..... 439/131; 439/172; 363/146
(58) Field of Search ..... 439/131, 170, 439/171, 172, 174; 363/143, 144, 145, 146

(56) References Cited

U.S. PATENT DOCUMENTS 5,613,863 A * 3/1997 Klaus et al. ..... 439/131
5,973,948 A * 10/1999 Hahn et al. ..... 363/146
6,126,460 A * 10/2000 Wu ..... 439/131
6,261,109 B1 * 7/2001 Liu et al. ..... 439/131

* cited by examiner

*Primary Examiner*—Hien Vu
(74) *Attorney, Agent, or Firm*—Hedman & Costigan, P.C.

(57) ABSTRACT

An electrical adapter is composed of a body and a changeable plug. The body has a housing being composed of a first semi-housing having a first notch and a second semi-housing having a second notch. A circuit plate is received in the housing and has a third notch and two strips respectively provided at a top and a bottom of the third notch. A first plug is rotatably mounted in the first notch and the second notch, and has a seat, two rods vertically extending through a top and a bottom of the seat respectively and electrically connected with the strips respectively, and two first blades horizontally inserted in the seat and respectively and electrically connected with the rods. The changeable plug has a connector with two passages for respectively receiving the first blades, and a second plug with at least two second blades perpendicular to the passages.

7 Claims, 6 Drawing Sheets

ELECTRICAL ADAPTER

BACKGROUND OF THE INVENTION

1. Field of the Invention

The present invention is related to an electrical adapter, and more particularly to an electrical adapter for a Personal Digital Assistant (PDA).

2. Description of Related Art

A PDA generally has an electrical adapter for power supply. Referring to FIGS. 6 and 7, the conventional electrical adapter has a body (80) and a changeable plug (81). The body (80) has a connector (801) to connect with the PDA and a rotatable plug (802) provided therein and having two first blades for being inserted in an electrical supply socket. The rotatable plug (802) is pivotable between a concealed position in a channel of the body (80) and a protruding position projecting from the body (80). Two rods (803) are provided in the rotatable plug (802) and respectively electrically connected with the first blades. The changeable plug (81) has two passages (811) defined at a rear end thereof for receiving first blades of the rotatable plug (802) respectively and two cylindrical second blades (812) are provided at a front end of the changeable plug (81).

In use, the rotatable plug (802) is turned outwards 90 degrees from its concealed position to its protruding position to electrically connect the rods (803) with strips (804) in the body (80), and the first blades are directly inserted in the socket. When the electrical adapter is used for a different socket, the first blades are inserted in the passages (811) of the changeable plug (81) and the second blades (812) are inserted in the socket.

However, if the first plug (802) is turned less than 90 degrees and not to the full protruding position, as shown in FIG. 8, the rods (803) may be not electrically connected with the strips (804). Moreover, the first blades can not be inserted in the passages (811) completely, and it is possible that the rotatable plug (802) is not electrically connected with the changeable plug (81). When either of the above cases occurs, there is no electricity supplied in the PDA which results in confusion and irritation of a user.

Therefore, the invention provides an improved electrical adapter to mitigate and/or obviate the aforementioned problems.

SUMMARY OF THE INVENTION

The main objective of the invention is to provide an electrical adapter which can be assembled with a changeable plug without necessarily having to turn a rotatable plug.

Other objects, advantages and novel features of the invention will become more apparent from the following detailed description when taken in conjunction with the accompanying drawings.

DETAILED DESCRIPTION OF THE PREFERRED EMBODIMENT

Figure 1:
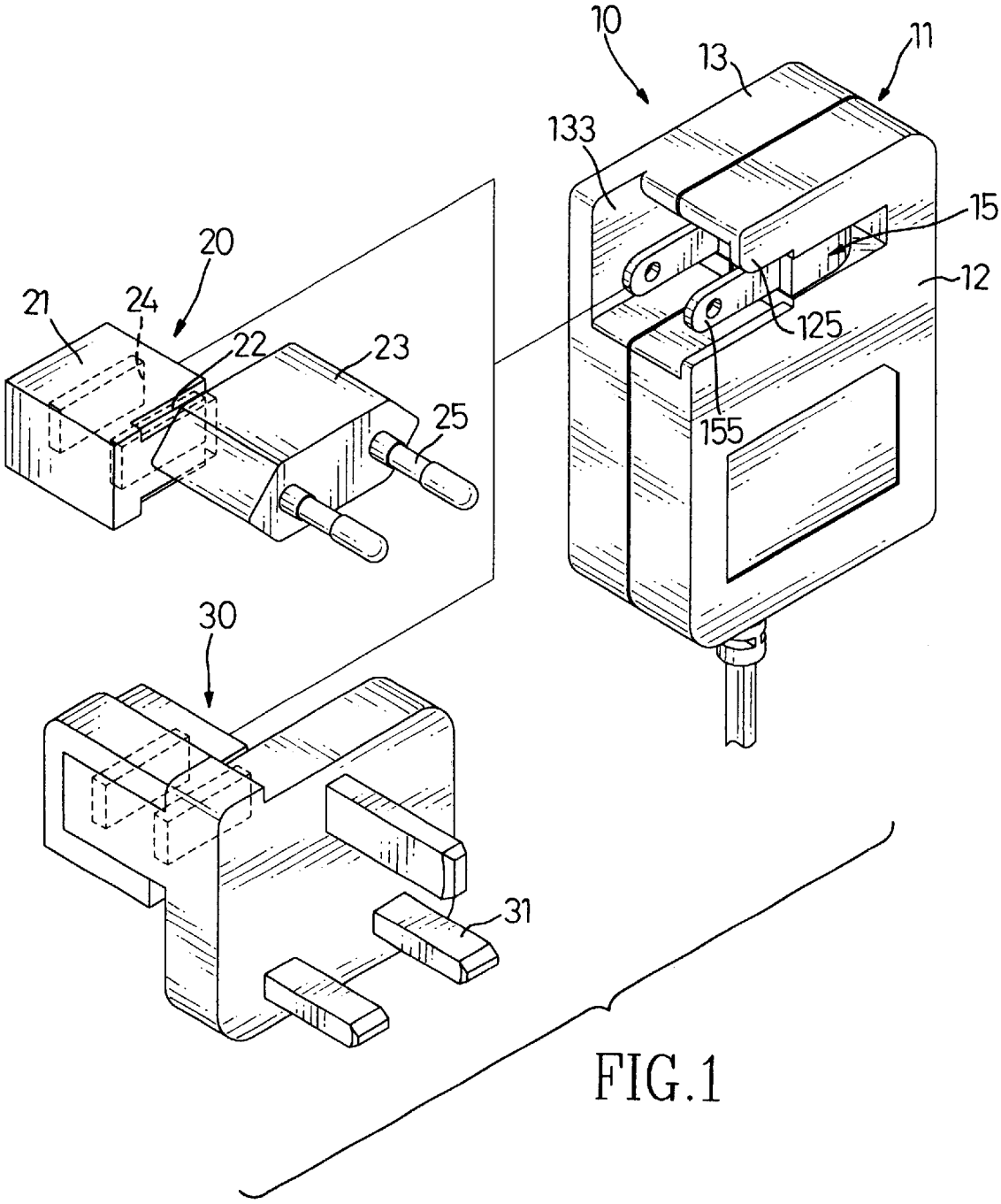
FIG. 1 is a perspective view of an electrical adapter in accordance with the invention.
Figure 2:
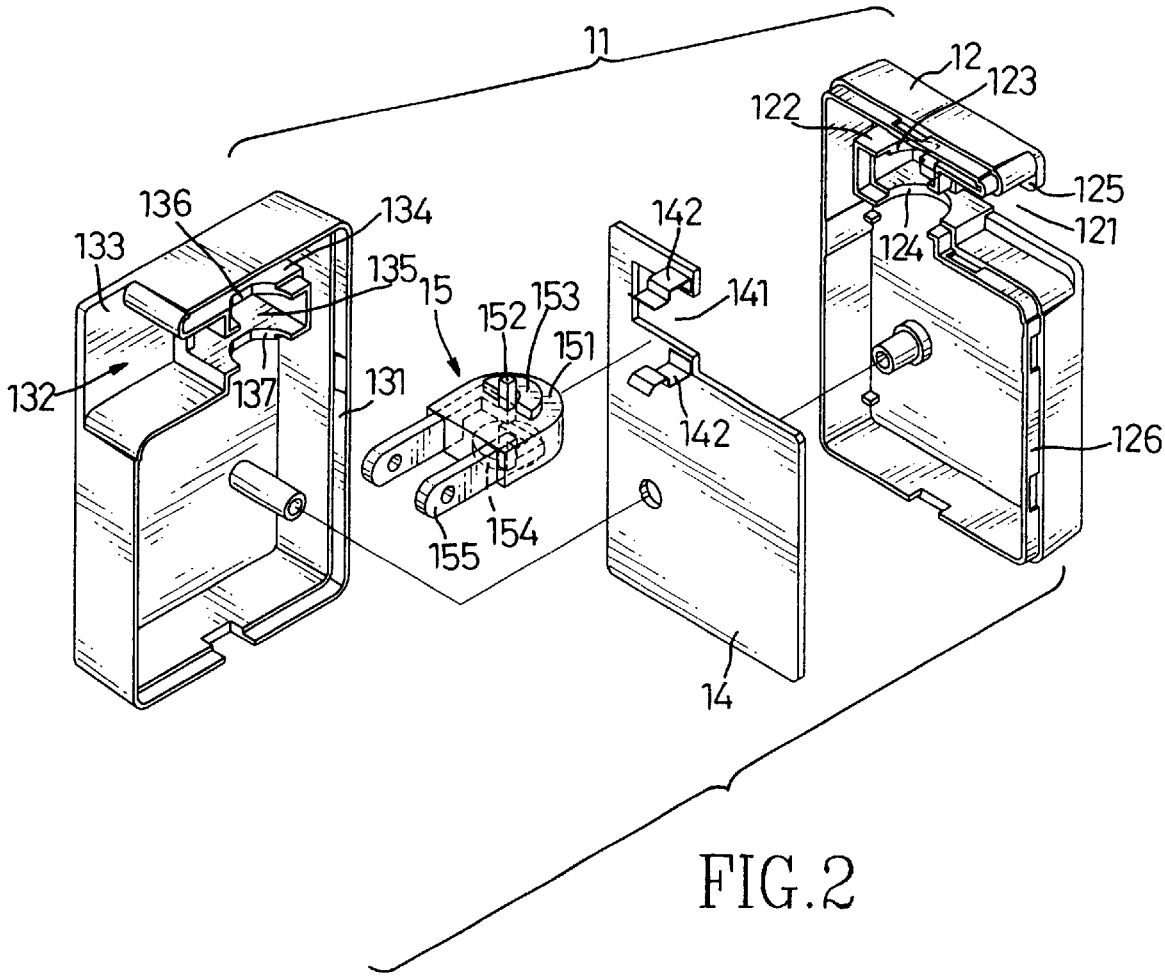
FIG. 2 is an exploded perspective view of a body of the electrical adapter.

Referring to FIGS. 1 and 2, an electrical adapter in accordance with the invention is composed of a body (10) and a changeable plug (20). The body (10) has a housing (11) formed with a first semi-housing (12) and a second semi-housing (13). A circuit plate (14) is received between the first semi-housing (12) and the second semi-housing (13). A first notch (121) is defined in the first semi-housing (12) and a first semi-bracket (122) is formed inside the first notch (121). The first semi-bracket (122) has a first upper hole (123) defined at a top thereof and a first lower hole (124) at a bottom thereof, wherein the first upper hole (123) is shaped as a quarter-circle, and the first lower hole (124) is shaped as a semi-circle. The first semi-housing (12) further has a baffle (125) formed at an outer side of the first notch (121).

The second semi-housing (13) is assembled with the first semi-housing (12) and has a recess (131) defined at the edge thereof to receive a protrudent edge (126) of the first semi-housing (12). Corresponding to the first semi-housing (12), the second semi-housing (13) has a second notch (132), a second semi-bracket (134), a second upper hole (136) and a second lower hole (137). The second upper hole (136) and the second lower hole (137) are shaped as semi-circles. The second semi-bracket (134) has a gap (135) defined between the second upper hole (136) and the second lower hole (137). A stop plate (133) is formed in the second notch (132) to close the outer side of the second notch (132).

A first plug (15) is rotatably received in the gap (135) and the first and second notches (121, 132). The first plug (15) has a seat (151) and two rods (152) respectively and vertically extending through a top and a bottom of the seat (151). A circular pad (154) is formed at a bottom of the seat (151) and a semi-circular pad (153) is formed at a top of the seat (151). The circular pad (154) is received in the circular lower hole formed by the first and second lower holes (124, 137) and the semi-circular pad (153) is received in the upper hole defined as a three-quarter circle and formed by the first and second upper semi-holes (123, 136). Thus, the first plug (15) cannot be turned outwards more than 90 degrees because the semi-circular pad (153) will be blocked. Two first blades (155) are horizontally inserted in the seat (151) and electrically connected with the rods (152) respectively.

The circuit plate (14) has a third notch (141) defined therein to correspond to the first and second notches (121, 132). Two elastic metal strips (142) having substantially S-shaped protions and electrically connected with electronic elements (not shown or numbered) on the circuit plate (14) are respectively provided at a top and a bottom of the third notch (141) and located above the upper holes (123, 136) and below the lower holes (124, 137). The rods (152) extend out from the upper holes (123,136) and the lower holes (124, 137) and are electrically connected with grooves of the strips (142) respectively. Thereby, the first blades (155) are electrically connected with the circuit plate (14) via the rods (152).

The changeable plug (20) is composed of a connector (21) and a second plug (23). The connector (21) has two passages

(24) defined therein to receive the first blades (155) respectively. A cutout (22) is defined at an upper corner of the connector (21) and the baffle (125) is accessed in the cutout (22) when the changeable plug (20) is assembled in the body (10). The second plug (23) has two second blades (25) perpendicular to the passages (24). In this embodiment, the second blades (25) are cylindrical. In another embodiment also shown in FIG. 1, the changeable plug (30) has a second plug with three second blades (31) each with a rectangular cross-section. It should be known by those skilled in the art that the second plug can be assembled with other blades with various cross-sections or quantities. The second blades (25, 31) are respectively electrically connected with copper sheets (not shown or numbered) secured in the passages (24).

Figure 3:
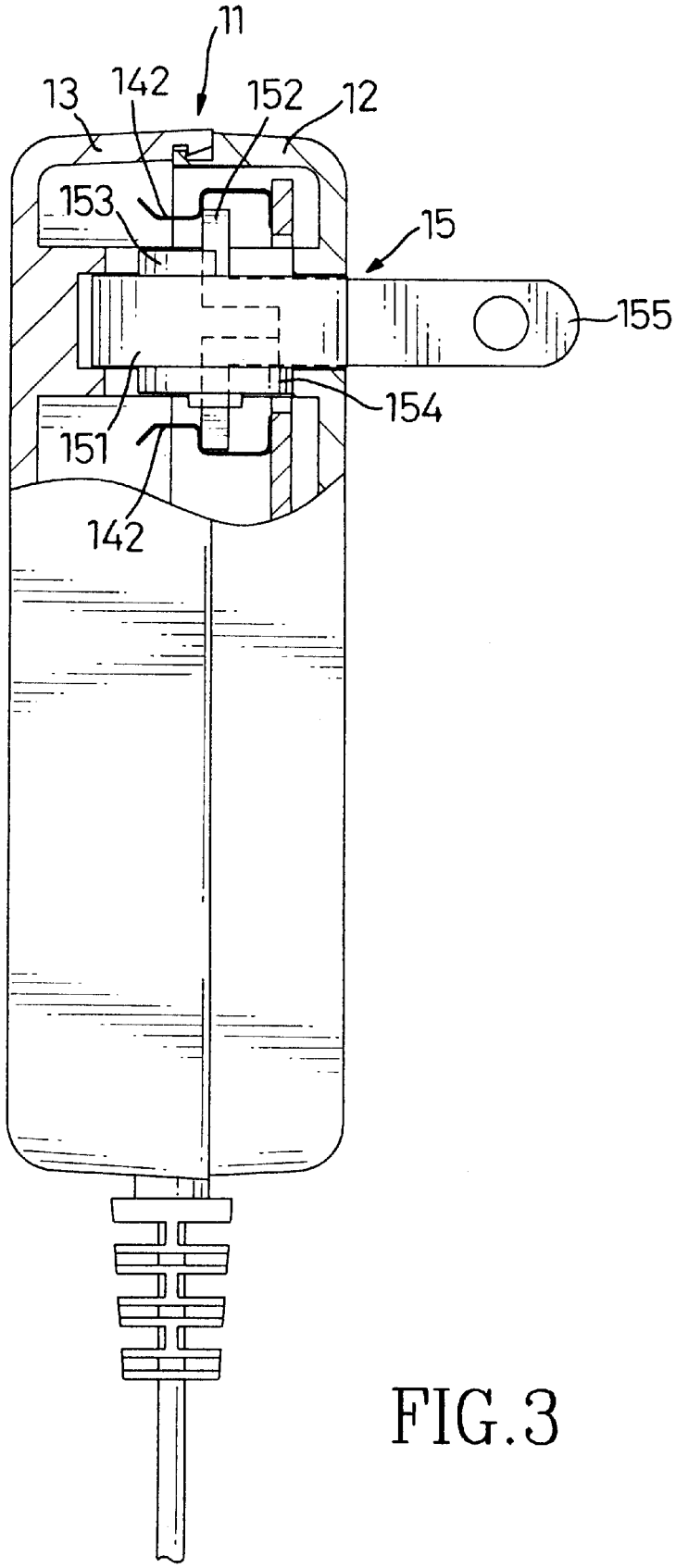
FIG. 3 is a side partial sectional view of the electrical adapter.
Figure 5:
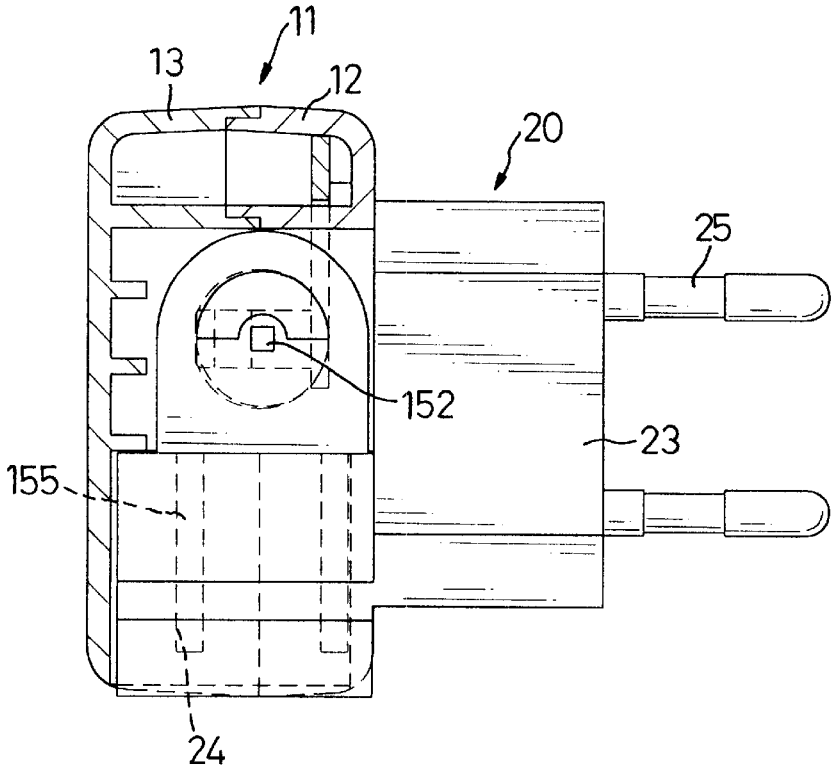
FIG. 5 is a top view of the electrical adapter.
Figure 4:
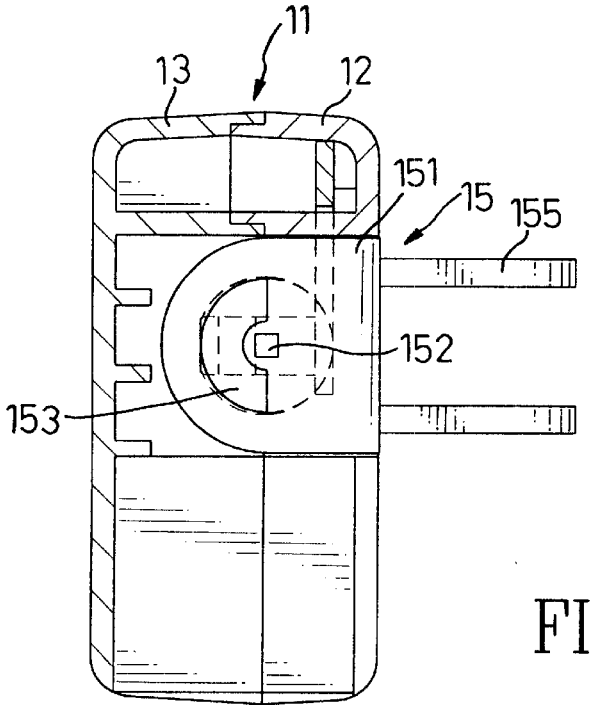
FIG. 4 is a top sectional view of the body of the electrical adapter.
Figure 6:
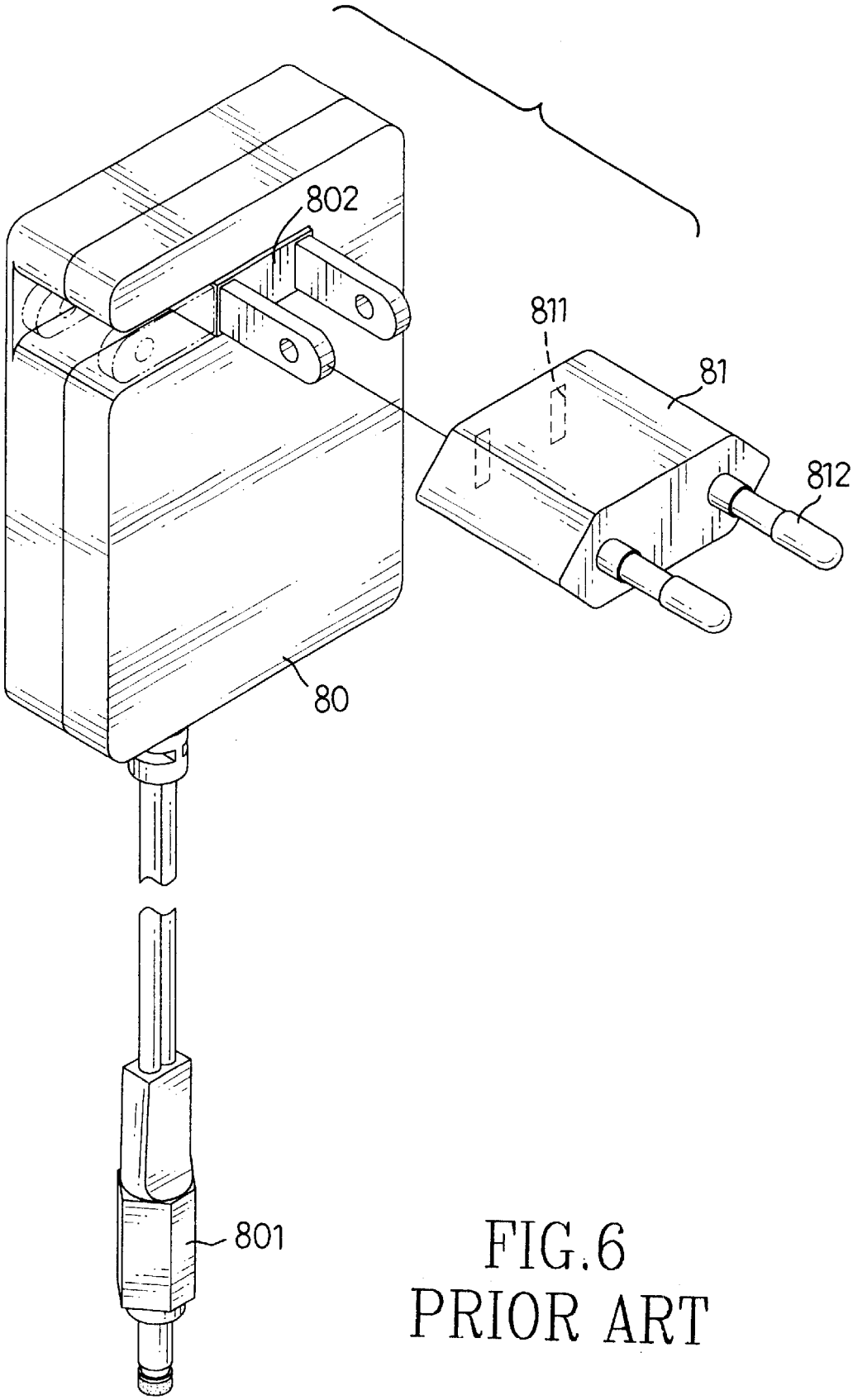
FIG.6 PRIOR ART
FIG. 6 is a perspective view of a conventional electrical adapter.
Figure 7:
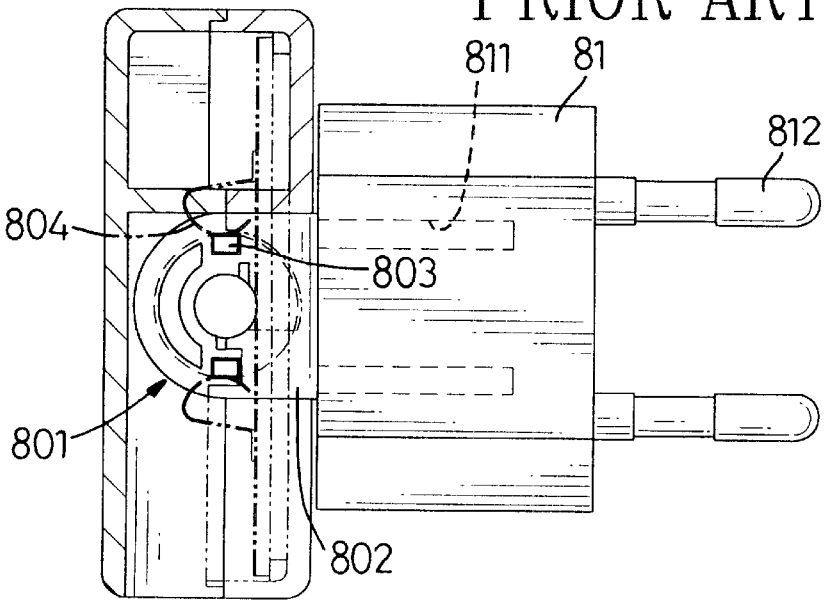
FIG.7 PRIOR ART
FIG. 7 is a top partial sectional view of the conventional electrical adapter.
Figure 8:
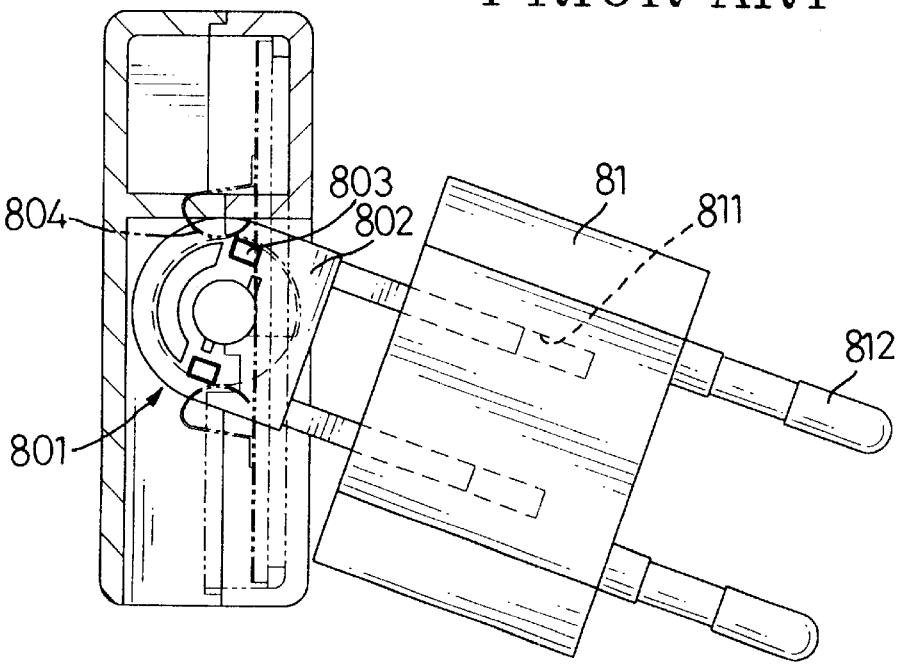
FIG.8 PRIOR ART
FIG. 8 is a top view showing that the conventional electrical adapter is used improperly.

Referring to FIGS. 3 and 4, when the body (10) is used singly, the first plug (15) is turned outwards 90 degrees and the first blades (155) can be inserted in a first socket. When the adapter is used for a second socket having apertures with various cross-sections, referring to FIG. 5, the first plug (15) need not be turned outwards and the connector (21) is received in the first and second notches (121, 132). The first blades (155) are respectively inserted in the passages (24) and the second blades (25) are inserted in the socket.

From the above description, it is noted that the invention has the following advantages:

1. When the changeable plug (20) is assembled to the body (10), the first plug (15) need not be turned outwards and the connector (21) can be directly inserted in the notches (121, 132), which is very simple and convenient for a user.
2. Because the connector (21) is fastened by the baffle (125) and the stop plate (133), it is secured in the body (10) and will not escape from the first and second notches (121, 132).
3. Because the rods (152) are always electrically connected with the strips (142), the electrical adapter of the invention has a good electrical performance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical adapter being composed of a body (10) and a changeable plug (20), wherein the body (10) has a housing (11) being composed of a first semi-housing (12) having a first notch (121), and a second semi-housing (13) having a second notch (132) corresponding to the first notch (121), a circuit plate (14) received in the housing (11) and having a third notch (141) corresponding to the first and second notches (121,132) and two metal strips (142) having substantially S-shape portions respectively provided at a top and a bottom of the third notch (141), a first plug (15) mounted in the first notch (121) and the second notch (132) and being pivotable between a first position and a second position perpendicular to the first position, and having a seat (151), two rods (152) vertically extending through a top and a bottom of the seat (151) respectively and continuously electrically connected with grooves of the strips (142) from the first position to the second position of the plug, and two first blades (155) horizontally inserted in a front end of the seat (151) and respectively and electrically connected with the rods (152); and the changeable plug (20) has a connector (21) with two passages (24) for respectively receiving the first blades (155), and a second plug (23) with at least two second blades (25) perpendicular to the passages (24).

2. The electrical adapter as claimed in claim 1, wherein the first semi-housing (12) has a first semi-bracket (122) formed inside the first notch (121), a first upper hole (123) shaped as a quarter-circle and defined at a top of the first semi-bracket (122); the second semi-housing (13) has a second semi-bracket (134) formed inside the second notch (132) and corresponding to the first semi-bracket (122), a second upper hole (136) shaped as a semi-circle and defined at a top of the second semi-bracket (134) and corresponding to the first upper hole (123); and the first plug (15) has a semi-circular pad (153) formed at a top thereof and received in the first and second upper holes (123, 136).

3. The electrical adapter as claimed in claim 2, wherein the first semi-housing (12) has a first lower hole (124) shaped as a semi-circle and defined at a bottom of the first semi-bracket (122); the second semi-housing (13) has a second lower hole (137) shaped as a semi-circle and defined at a bottom of the second semi-bracket (134) and corresponding to the first lower hole (124); and the first plug (15) has a circular pad (154) formed at a bottom thereof and received in the first and second lower holes (124, 137).

4. The electrical adapter as claimed in claim 1, wherein the first semi-housing (12) has a protrudent edge (126), and the second semi-housing (13) has a recess (131) to receive the protrudent edge (126).

5. The electrical adapter as claimed in claim 1, wherein the second blades (25) are cylindrical.

6. The electrical adapter as claimed in claim 1, wherein the second plug has three second blades (31).

7. The electrical adapter as claimed in claim 6, wherein the three second blades each have a rectangular cross-section.

* * * * *